US008602394B2

(12) United States Patent
Christiansen

(10) Patent No.: US 8,602,394 B2
(45) Date of Patent: Dec. 10, 2013

(54) WINCHING APPARATUS

(75) Inventor: Douglas J. Christiansen, Lindon, UT (US)

(73) Assignee: Douglas J. Christiansen, Lindon, UT (US)

( * ) Notice: Subject to any disclaimer, the term of this patent is extended or adjusted under 35 U.S.C. 154(b) by 228 days.

(21) Appl. No.: 12/987,579

(22) Filed: Jan. 10, 2011

(65) Prior Publication Data

US 2011/0168961 A1 Jul. 14, 2011

Related U.S. Application Data

(60) Provisional application No. 61/294,023, filed on Jan. 11, 2010.

(51) Int. Cl.
*B66D 1/36* (2006.01)

(52) U.S. Cl.
USPC ..... 254/338; 254/323; 254/327; 254/383

(58) Field of Classification Search
USPC ..... 254/323, 325, 326, 327, 336, 338, 383
See application file for complete search history.

(56) References Cited

U.S. PATENT DOCUMENTS

| | | | | |
|---|---|---|---|---|
| 2,738,143 | A * | 3/1956 | Hannay | 242/157.1 |
| 3,309,066 | A * | 3/1967 | Carlson et al. | 254/268 |
| 3,899,093 | A * | 8/1975 | Allen | 254/415 |
| 3,976,210 | A * | 8/1976 | Allen | 414/559 |
| 4,296,917 | A * | 10/1981 | Day et al. | 254/400 |
| 4,400,132 | A * | 8/1983 | Deline et al. | 414/569 |
| 5,183,282 | A | 2/1993 | Smyly | |
| 5,393,194 | A | 2/1995 | Smith | |
| 6,631,886 | B1 * | 10/2003 | Caudle et al. | 254/327 |
| 7,344,120 | B2 * | 3/2008 | McFarland | 254/323 |
| 2006/0201980 | A1 * | 9/2006 | Koons | 224/511 |

* cited by examiner

*Primary Examiner* — Emmanuel M Marcelo
(74) *Attorney, Agent, or Firm* — R. Camden Robinson; Van Cott, Bagley, Cornwall & McCarthy P.C.

(57) ABSTRACT

A winching apparatus includes a fairlead mounted to a vehicle and a fifth roller mounted below the fairlead that is positioned and sized such that the cable does not contact any portion of the vehicle between the fairlead and the fifth roller when the cable passes from the winch and under the vehicle.

22 Claims, 9 Drawing Sheets

WINCHING APPARATUS

The present application claims the benefit under 35 U.S.C. §119(e) of U.S. Provisional Application No. 61/294,023, filed Jan. 11, 2010.

BACKGROUND

A winch is a device which is designed to controllably pay out or retract a cable. Front mounted vehicle winches are designed to pull or retract the cable from the front of the vehicle. However, in some situations a front mounted winch in a standard configuration is not able to perform a desired task. For example, when a vehicle has advanced through terrain and cannot proceed forward, a front mounted winch in a standard configuration is not able to pull the vehicle backwards out of the terrain. Similarly, a front mounted winch in a standard configuration is unable to provide forward descent winching of a vehicle. In both these situations, the cable extending from the front mounted winch needs to be attached to an anchor point behind the vehicle. To do this, the cable must pass under or around the vehicle to attach to the rear anchor point. This approach is not safe or effective because the cable would pass over sharp edges, become entangled in the undercarriage or wheels, and rub on portions of the vehicle. This will reduce the rearward winching power and damage the cable and vehicle.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
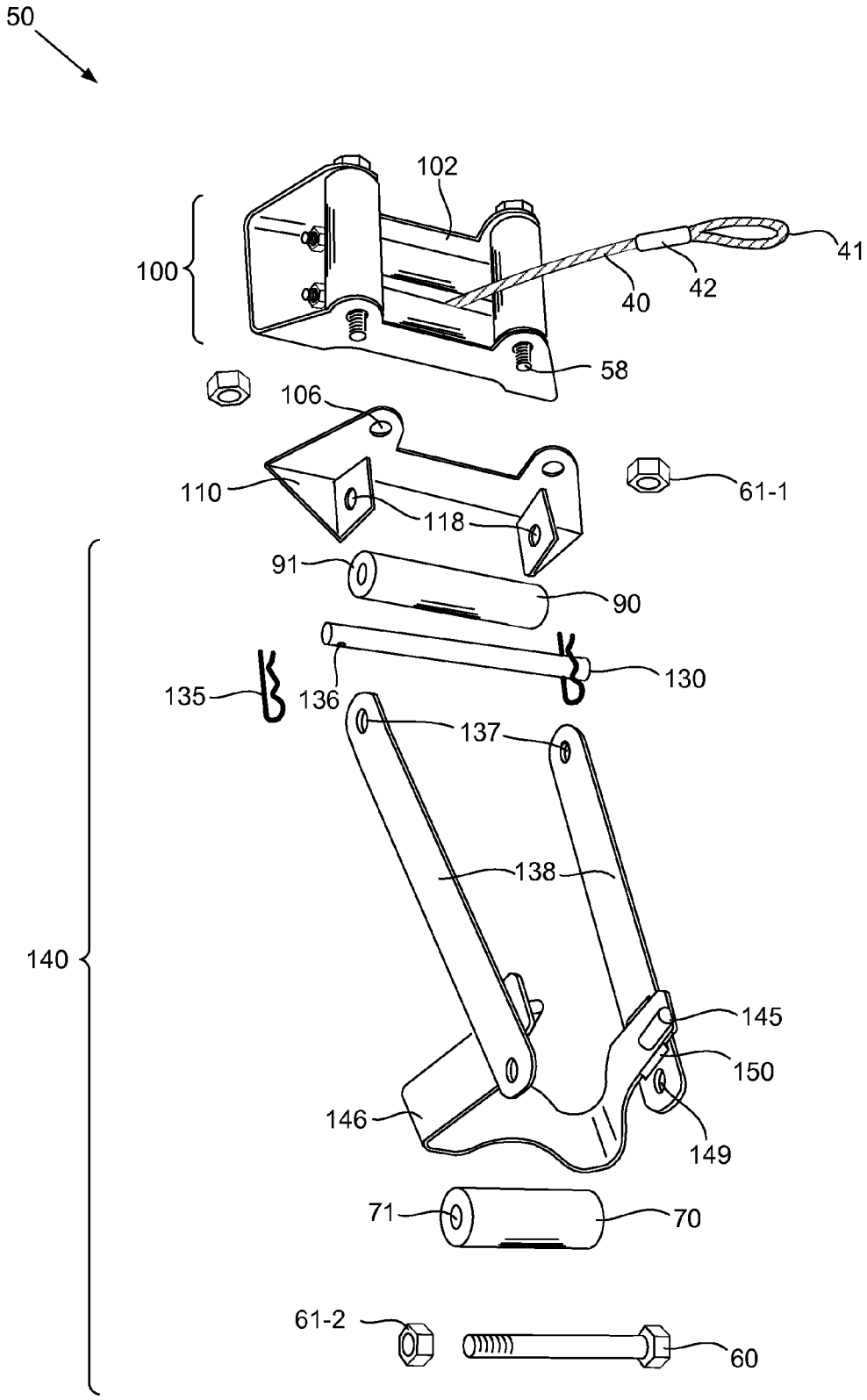
FIG. 1 is an exploded perspective view of an illustrative REVERSAROLLER winching apparatus, according to one example of principles described herein.

A winch is a device which is designed to controllably retract or pay out cable or synthetic rope. Vehicle mounted winches are often powered by a DC (Direct Current) electric motor and include a gear box connected to a drum. A cable is wound around the drum and can be controllably extended or retracted by appropriate rotation of the drum. The gear box provides speed and torque conversion between the electric motor and the drum to increase the pulling power of the winch.

Front mounted vehicle winches are designed to pull or retract the cable from the front of the vehicle. There are many instances when a front mounted winch in a standard configuration is unable to perform the task at hand because the cable from the front mounted winch can only be attached to anchor points which are to the front or sides of the vehicle. Attempts to fasten the cable to anchor points at the rear of the vehicle result in contact between the cable and the vehicle and can result in damage to the cable and/or the vehicle. When the cable is routed underneath the carriage of the vehicle to reach a rear anchor point, the cable can easily get tangled in the wheels, power train, or other parts of the undercarriage. Winching power is also reduced by pinching and rubbing as the cable passes over and around components of the vehicle. Further, the vehicle may become unstable during rearward winching. For example, a front mounted winch in a standard configuration is not suitable for forward decent winching, self rescue by rear winching, or providing winching assistance to a second vehicle behind the first vehicle.

The specification describes a REVERSAROLLER winching apparatus which conveniently and safely routes a winching cable beneath a vehicle to a rear anchor point. The REVERSAROLLER winching apparatus stabilizes the cable underneath the vehicle using rollers, an extension arm, and a rear link. The REVERSAROLLER maintains the winching power of the front mounted winch while winching from a rear anchor point and prevents damage to the vehicle, winch, and cable. The REVERSAROLLER maintains the stability of the vehicle during the winching process.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

For purposes of explanation, the REVERSAROLLER winching apparatus is illustrated as mounted on the front of an All Terrain Vehicle (ATV). However, the REVERSAROLLER winching apparatus and the principles described herein are broadly applicable to vehicles with a front mounted winch. By way of example and not limitation, these vehicles may include sand rails, dune buggies, 4×4 trucks, rock crawlers, military vehicles, and other off road vehicles.

A standard winch assembly that is found on All Terrain Vehicles (ATV's) may include: a DC motor with gear reduction, a spool which is able to coil a limited amount of cable, wire, or synthetic rope, a cable end loop at the end of the rope or cable and a roller fairlead assembly. A standard roller fairlead includes four rollers which the cable passes through. There are rollers above, below, and to either side which form an opening through which the cable passes. The rollers guide the cable into the cable housing and protect the cable from the sharp edges of the cable housing, surrounding body parts and sharp edges located nearby. The roller fairlead also permits the cable to change the angle of pull, whether up, down, or from either side. There are also controls to operate the winch motor in forward and reverse. The cable end loop is attached to a stationary object such as a tree, another ATV or vehicle with a hook, a shackle or a strap of some sort for an anchor point.

The standard winch assembly is found on many ATVs and is used for common tasks such as raising a snow plow blade for typical snow plow operations, or for rescue of a stuck vehicle or ATV. They are also used for lifting an ATV for maintenance. Winches could be used for a variety of other tasks or emergencies. These winch assemblies are typically mounted on the front of the ATVs or off road vehicles and are designed for pulling from the front direction including up, down, and to either side.

In the event that pulling must be performed toward the rear, the front mounted winching designs located on ATVs would not work because the cable cannot be safely navigated underneath the ATV from the front winch to the rear of the vehicle. Current winch designs include many hazards such as the metal bracket of the roller fairlead and undercarriage obstacles. In most rescue situations, large forces can be generated by the winch to pull the vehicle or ATV to safety. To effectively and safely perform winching, the cable should be routed from the cable housing to the anchor point over appropriately designed surfaces. If the cable is forced across a sharp edge or angle it could break, resulting in a more hazardous situation where damage to the ATV and/or injury to nearby parties could result. It should also be noted that if the winch motor is forced to pull a cable across a sharp edge, a substantial amount of pulling power is lost. This could also hamper the rescue effort.

The ability of a winch to safely pull from the rear can be important because an anchor point in the rear of the vehicle often provides the best method for resolving many rescue situations. If a vehicle gets stuck going forward, the best way out is usually backwards. Other situations may also require winching backwards. One of these situations would be pulling another vehicle or ATV from a stuck position. In this situation, there are three factors which make winching backwards desirable: first, most tires on off road vehicles have directional tire tread for increased traction in the forward direction. Second, the steering linkage is more easily damaged by pulling from the front. Third, it is often difficult or impossible to turn a vehicle around to assist the other vehicle. In almost all cases pulling from the rear would be safer and cause less damage to ATV's or vehicles doing the pulling. The rescuing ATV will also have better traction and control during the winching process.

If the winch is mounted on the front of the vehicle, the most direct routing of a cable from the winch to a rear anchor point is underneath the vehicle or ATV. The REVERSAROLLER winching apparatus provides safe routing of this cable during reward winching. The REVERSAROLLER winching apparatus includes rollers attached to the roller fairlead which provide clearance of sharp edges and obstacles located on the front and undercarriage of the vehicle. The rollers also redirect the cable angles without undesirable loss of winching power. These rollers are mounted to a removable extension arm which can be conveniently attached to the fairlead when winching is necessary without impeding available ground clearance.

FIG. 1 is an exploded perspective view of a REVERSAROLLER winching apparatus (50). In this example, a roller fairlead (100) includes four rollers which protect the cable (40) from the sharp edges of the fairlead bracket (102), surrounding body parts or sharp edges located nearby. The fairlead could have a variety of other configurations. For example, the fairlead may include a smooth collar which replaces the rollers and allows a synthetic rope to be used for winching. As used in the specification and appended claims, the term "fairlead" refers to any device or mechanism which directs a rope or cable into a winching device from a range of angles. The fairlead will protect the rope or cable from abrasion and undesirable contact with the vehicle through a range of design angles.

The cable (40) which passes through the fairlead (100) has a crimp (42) and a loop (41) that makes it able to attach to an anchor point. The roller fairlead (100) also permits the cable (40) to be used through a limited range of angles, including up, down, or from either side. In this implementation, a fifth roller bracket (110) is attached to the roller fairlead (100) with two bolts (58) and nuts (61-1) that are attached through holes (106) in the fifth roller bracket (110). In other embodiments, the fifth roller bracket (110) can be an integral part of the roller fairlead (100) or may be permanently welded to the fairlead bracket (102). In some embodiments, the fairlead roller adjacent and parallel to the fifth roller (90) is larger than the other fairlead rollers. As used in the specification and appended claims, the term "fifth roller" refers to a roller or skid plate below a fairlead regardless of whether the fairlead has a specific number of rollers. For example, some fairleads are formed from a continuous smooth collar and do not have rollers in a conventional sense. In addition, roller fairleads may have a varying number of rollers.

An extension arm (140) is detachably connected to the fifth roller bracket (110) by a removable pin (130). In this example, the removable pin (130) is a clevis pin (130) which slides through roller bracket holes (118), extension arm holes (137) and through the center hole (91) of the fifth roller (90). The clevis pin (130) is held in place with one or two hair pin clips (135) which attach to the clevis pin (130) through holes (136) drilled in either end of this clevis pin (130). This configuration would permit the clevis pin (130) to be removed from either end. The clevis pin (130) could also take other forms such as a safety spring pin, a tension lock pin or a standard bolt and nut.

The extension arm (140) can be formed in a variety of ways. In this example, the extension arm (140) is formed from three pieces of metal which are welded together. Two extension arm sides (138) are welded to a standoff bracket (146) by welds (150). The extension arm (140) also has a bottom roller (70) which is held in place with a bolt (60) and a nut (61-2). The bolt (60) extends through holes (149) that are located in the extension arm sides (138) and also extends through a hole (71) in the center of the bottom roller (70).

The winching apparatus (50) incorporates cable guides (145) and a standoff bracket (146) to safely route the cable (40) under the vehicle. The cable guides (145) could take other forms, such as a molded plastic guide, which could be mounted to the front skid plate of the ATV, or a roller with guides mounted to the axles of an off road vehicle.

Figure 2:
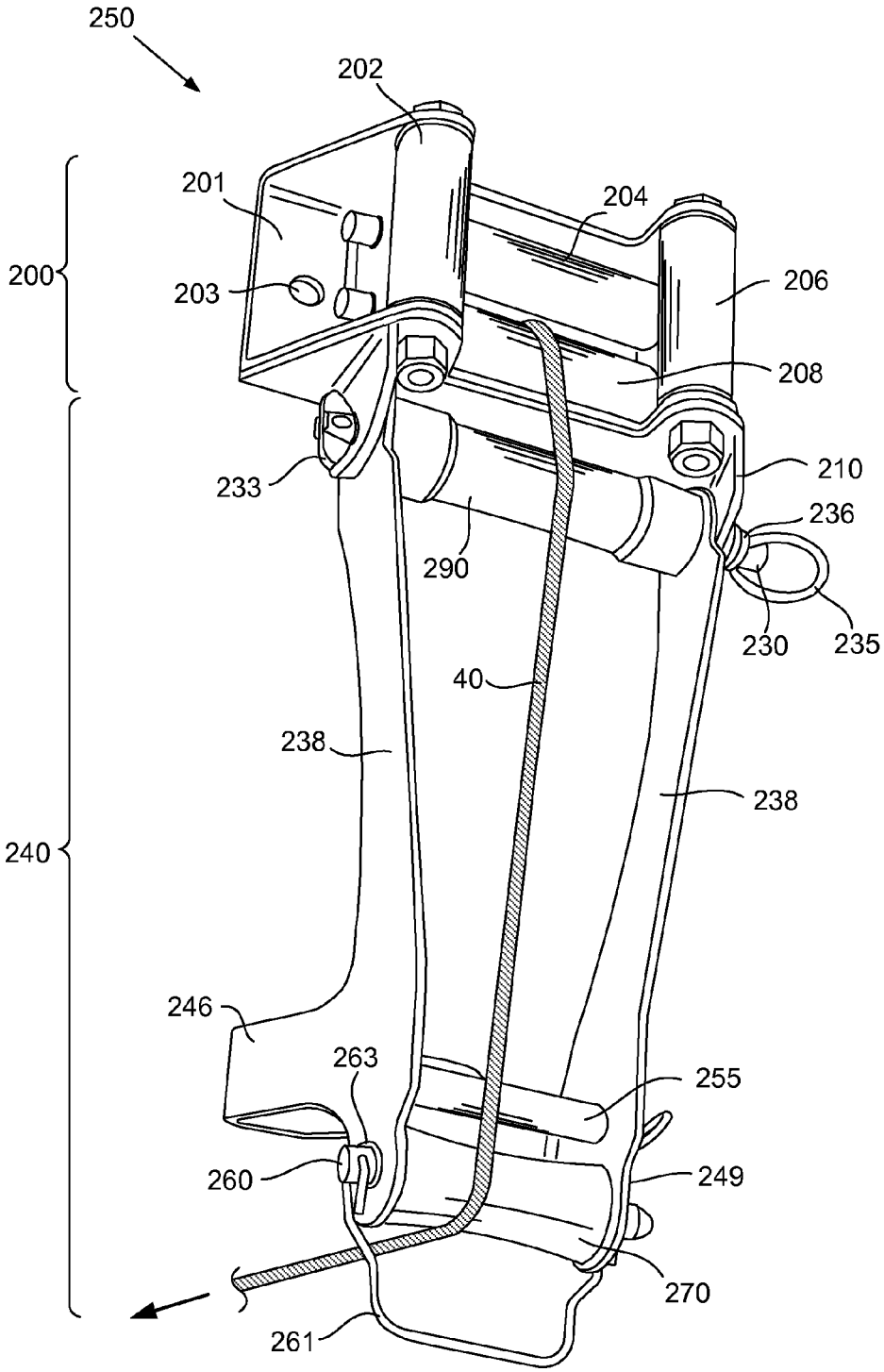
FIG. 2 is a perspective view of an illustrative REVERSAROLLER winching apparatus, according to one example of principles described herein.

FIG. 2 is a perspective view of another illustrative REVERSAROLLER winching apparatus (250). The roller fairlead (200) includes a fairlead bracket (201) and four rollers (202, 204, 206, 208). The fairlead bracket (201) is attached to the frame of the vehicle through bolt holes (203). Three of the rollers (202, 204, 206) are the same diameter, but the fourth roller (208) is slightly larger to provide for additional clearance of the cable (40) as it passes over the edge of the fairlead bracket (201) and the fifth roller bracket (210). In this embodiment, the fifth roller bracket (210) is an integral part of the fairlead bracket (201).

A tension locking pin (230) attaches the fifth roller (290) and extension arm (240) to the fifth roller bracket (210) and fairlead bracket (201). The tension lock pin (230) has a pivotable piece (233) on the end of the pin (230) which is aligned with the longitudinal axis of the pin during insertion and then rotated crosswise to keep the pin (230) in place. A spring (236) on the opposite side of the pin (230) biases the pivotable piece (233) against the fifth roller bracket (210) so that the pivotable piece (233) does not accidentally rotate. To remove the pin (230), the spring (236) is depressed and the pivotable piece (233) is manually rotated so it is in alignment with the pin (230). This allows the pin (230) to slide out easily when it is necessary to detach the extension arm (240). A pull ring (235) at one end of the pin (230) can be used to slide the pin (230) out of the fifth roller bracket (210), extension arm (240), and fifth roller (290). The extension arm (240), with or without the fifth roller (290), can then be stowed away until the next use. The tension locking pin (230) is only one example of a quick release mechanism which could be used to detach a portion of the REVERSAROLLER winching device when the device is not in use.

In this implementation, the fifth roller (290) is shaped to bias the cable toward a center portion of the roller. This is accomplished by reducing the diameter of the center portion of the fifth roller (290). This moves the cable away from the extension arms sides (238), while still allowing the cable to be wound uniformly onto the winch. In some embodiments, where the cable angle over the roller is not great, a skid plate can be used as the fifth roller. This may be particularly advantageous when using synthetic rope which is less abrasive than metal cable. Additionally, the fifth roller may be mounted to the body of the vehicle rather than directly mounted to the fairlead or an extension of the fairlead. The extension arm (240) in this embodiment includes extension arms sides (238) and a standoff bracket (246) which are formed from a single piece of shaped metal. The extension arm (240) also includes a spacer pin (255) that is welded between the extension arm sides (238) to maintain the spacing between the extension arm sides (238) when a load is applied. The bottom roller (270) has a concave profile that biases the cable (40) centered down the center of the winching apparatus (250) and properly positions it with respect to the underside of the vehicle. The bottom roller (270) can be fastened in a variety of ways including a bolt and nut, an e-clip (263), E ring, or ball detents.

The standoff bracket (246) allows for accurate clearance under a particular type of vehicle. The standoff bracket (246) is formed so that its bottom rests on a structural portion of the vehicle. The height of the standoff bracket (246) is selected so that the cable (40) does not contact the undercarriage or other portions of the vehicle as the cable (40) passes to the rear of the vehicle. Because there are a wide variety of vehicle sizes and geometries, adaptation of the extension arm to fit a given vehicle type can optimize the operation of the REVERSAROLLER winching apparatus (250). For example, the height of the standoff bracket (246) can be selected to ensure that the cable does not adversely contact the undercarriage of a specific vehicle while maintaining the ground clearance of the vehicle. Some of these illustrative embodiments of the extension arm (240) are discussed below with respect to FIGS. 4A-4C. These embodiments show adaptations of the standoff bracket (146, FIG. 1; 246, FIG. 2) and extension arm sides (138, FIG. 1; 238, FIG. 2) for a variety of vehicles.

A pivotable cable retention wire (261) is a shaped wire clip that is attached to one side of the bottom roller pin (260) and clips over the opposite side of the bottom roller pin (260). The cable retention wire (261) can be opened to insert or remove the cable (40). The cable retention wire (261) prevents the cable from moving away from the bottom roller (270). For example, during set up of the REVERSAROLLER winching apparatus and connection of the cable (40) to the rear anchor point, there may be significant slack in the cable (40). The cable retention wire (261) keeps the slack cable aligned with the bottom roller (270) so that when tension is applied to the cable (40), the cable contacts the bottom roller (270).

Figure 3:
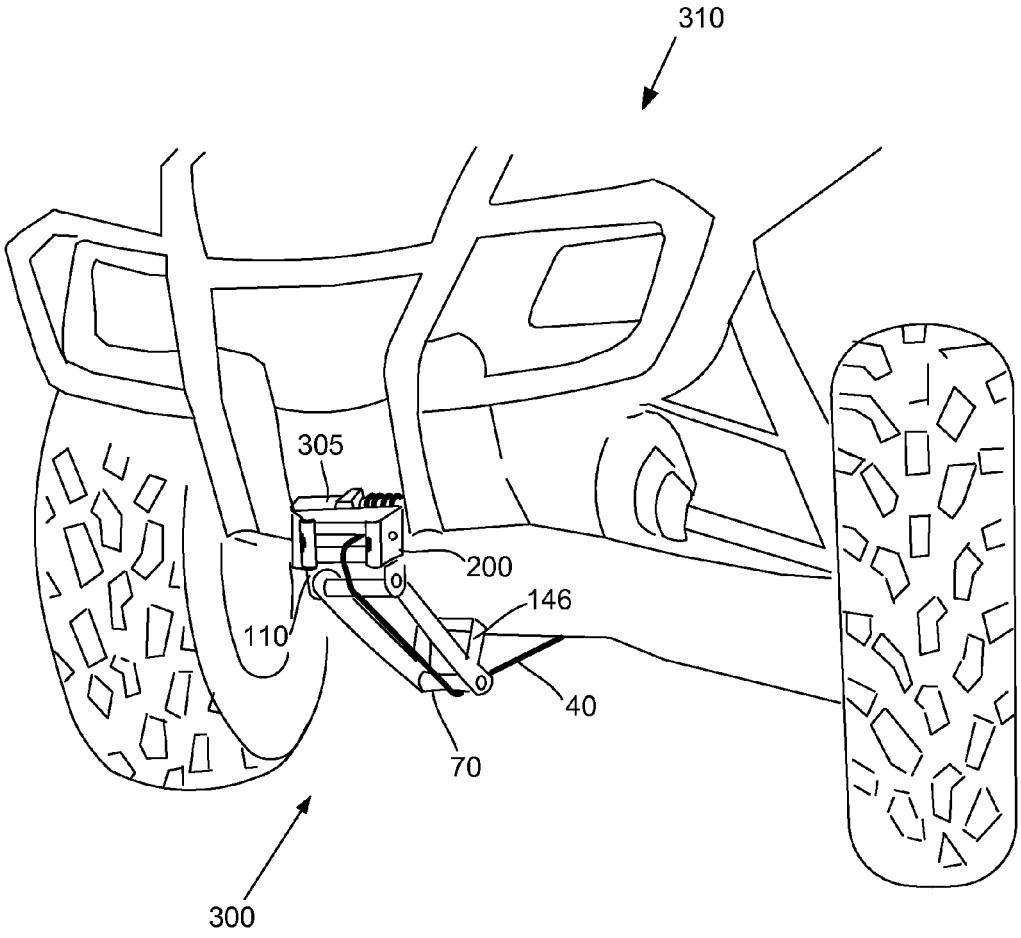
FIG. 3 is a perspective view which shows an illustrative REVERSAROLLER winching apparatus which routes a winch cable beneath the undercarriage of a vehicle, according to one example of principles described herein.

FIG. 3 is a perspective view of an ATV (310) with a REVERSAROLLER winching apparatus (300) mounted to a front mounted winch (305). In FIG. 3 the winch cable (40) is wound on the winch drum and exits through the roller fairlead (200). The cable (40) passes over the fifth roller bracket (110), the bottom roller (70), and under the ATV (310). The standoff bracket (146) is configured to provide support and clearance for the winching apparatus (300) to safely route the cable (40) to the rear of the ATV (310) without adversely affecting the available ground clearance. As shown in FIG. 3, the REVERSAROLLER winching apparatus (300) allows for safe attachment of the cable (40) to a rear anchor point without compromising the winching power or safety of the vehicle.

Figure 4A:
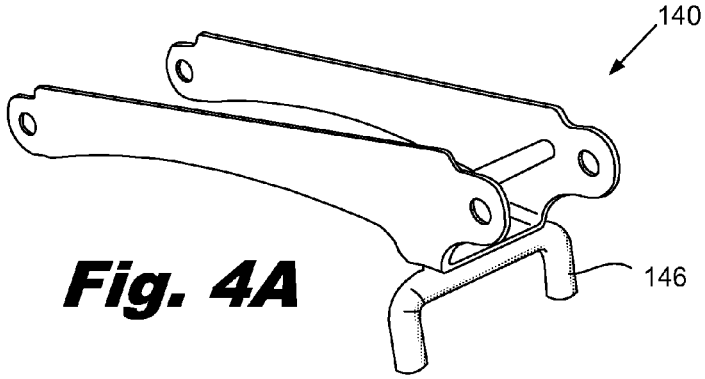
FIGS. 4A, 4B and 4C are perspective views of various illustrative extension arms, according to one example of principles described herein.
Figure 4B:
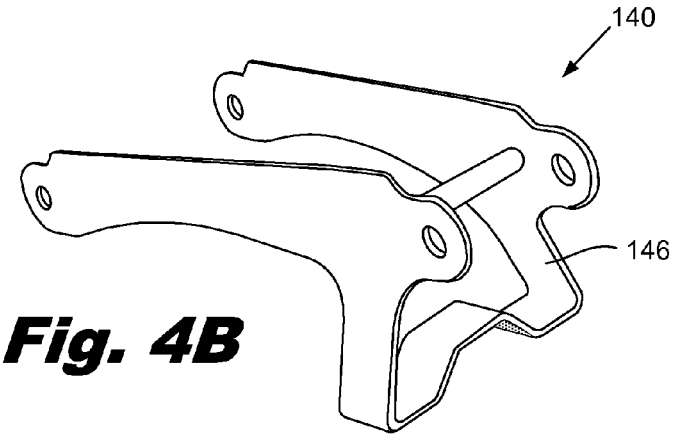
Figure 4C:
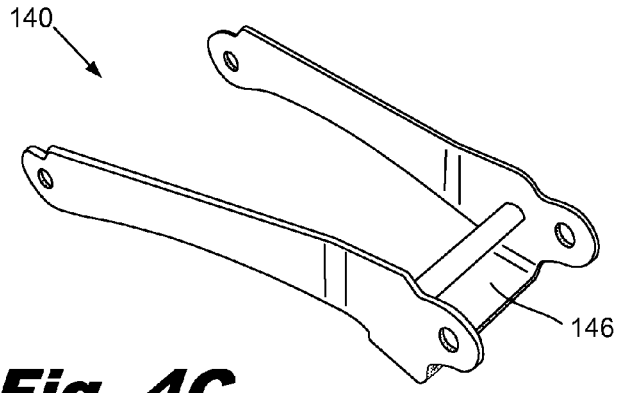

FIGS. 4A-4C show alternate configurations of the extension arm (140) to accommodate various vehicle designs. Each of these configurations adapts to a particular type of vehicle to allow maximum clearance for that vehicle. FIG. 4A shows an extension arm (140) which includes a "U" shaped standoff bracket (146) which is formed from a shaped metal rod. The ends of the shaped metal rod contact the undercarriage of the vehicle at appropriate locations. The height of the standoff bracket (146) is configured to place the extension arm at the appropriate angle for the cable to clear the undercarriage of the vehicle.

FIG. 4B shows an extension arm (140) which has an integral standoff bracket (146). This standoff bracket (146) is formed with two flat portions and a raised center portion. The flat portions contact the undercarriage of the vehicle and the raised center portion avoids contact with the undercarriage. The raised center of the standoff bracket (146) may be used to avoid disturbing a bolt, wiring, or nonstructural portion of the vehicle. FIG. 4C shows another illustrative embodiment of an extension arm (140) with a relatively low standoff bracket (146) that has a flat bottom. Consequently, for this vehicle type, the extension arm (140) rests relatively close to the body of the vehicle.

The extension arms (140) may have variety of other configurations. For example, the edges of the extension arms (140) could be protected by rock guards to give them increased resistance to abrasion when the front of the vehicle encounters rocks, soil, debris, or mud. According to one embodiment, the rock guards could include thickening of the leading edges of the extension arms by welding a rod along their length. Additionally, extension arms (140) could include a mud guard. When the vehicle is operated in deep mud, the mud guard directs mud downward and away from the vehicle. This preserves the function of the REVERSAROLLER by reducing the amount of rocks or debris which could become trapped in the extension arm. The mud guard could include a metal plate which is welded between the two side arms at an angle which directs the flow of mud in the desired direction.

Figure 5A:
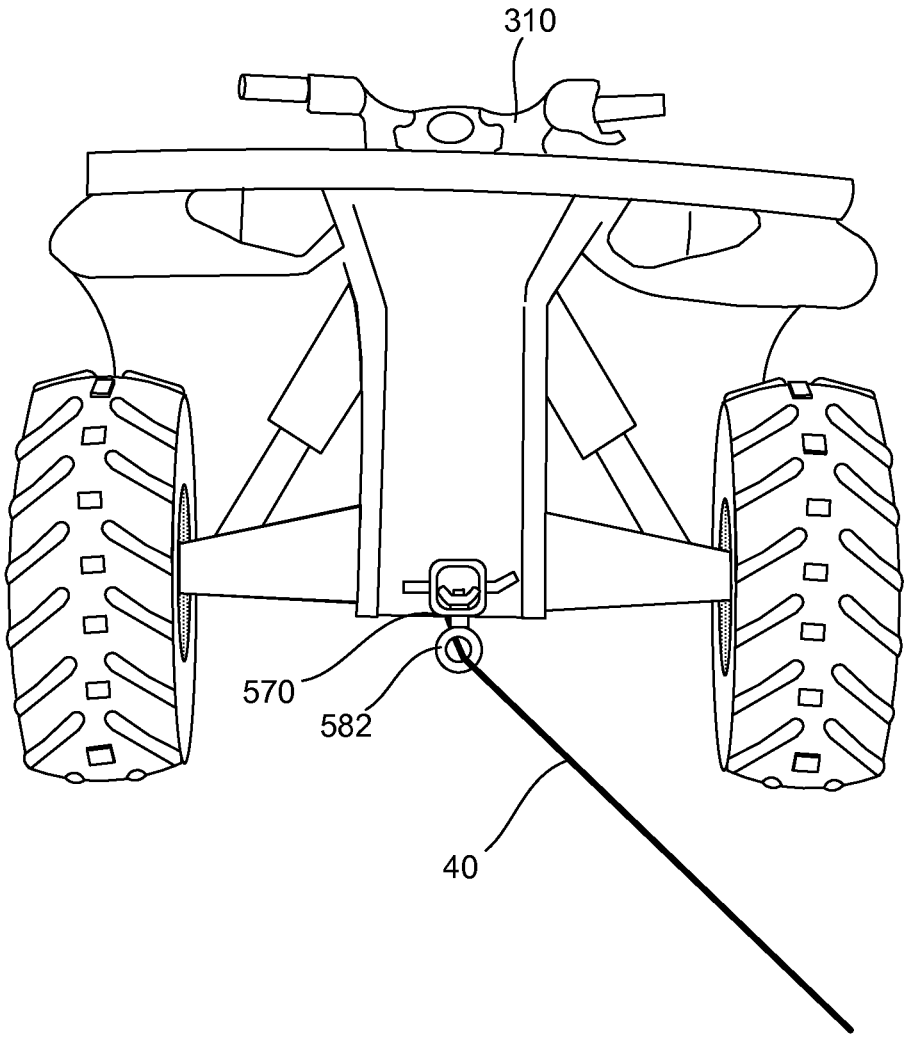
FIG. 5A is a perspective view which shows the cable passing through an illustrative REVERSAROLLER rear link, according to one example of principles described herein.

FIG. 5A is a perspective drawing which shows how the winch cable (40) is routed at the rear of an ATV (310) through a rear link (582) that is attached to a rear portion of the vehicle chassis. In many cases, the rear link (582) is attached to a towing attachment point at the rear of the vehicle. The towing attachment points typically have a number of advantages, including ready accessibility and mechanical robustness. In this example, the rear link (582) is an bolt eye which is connected to a receiver hitch on the rear of the ATV (310). The rear link (582) serves a number of purposes, including maintaining the direction and position of the cable (40) as it passes under the vehicle. This allows the clearance set by the bottom roller (70, FIG. 1) and the standoff bracket (146, FIG. 1) beneath the undercarriage of the vehicle to be maintained. The rear link (582) also allows the angle of the cable (40) to be changed after it exits from the rear link (582). This allows any available rear anchor point to be selected from a wide range of angles behind the vehicle. The rear link (582) could be formed using any of a number of retention devices and could be adapted to a given situation or could be a variety of different types, using the one that is best suited to a particular vehicle.

Figure 5B:
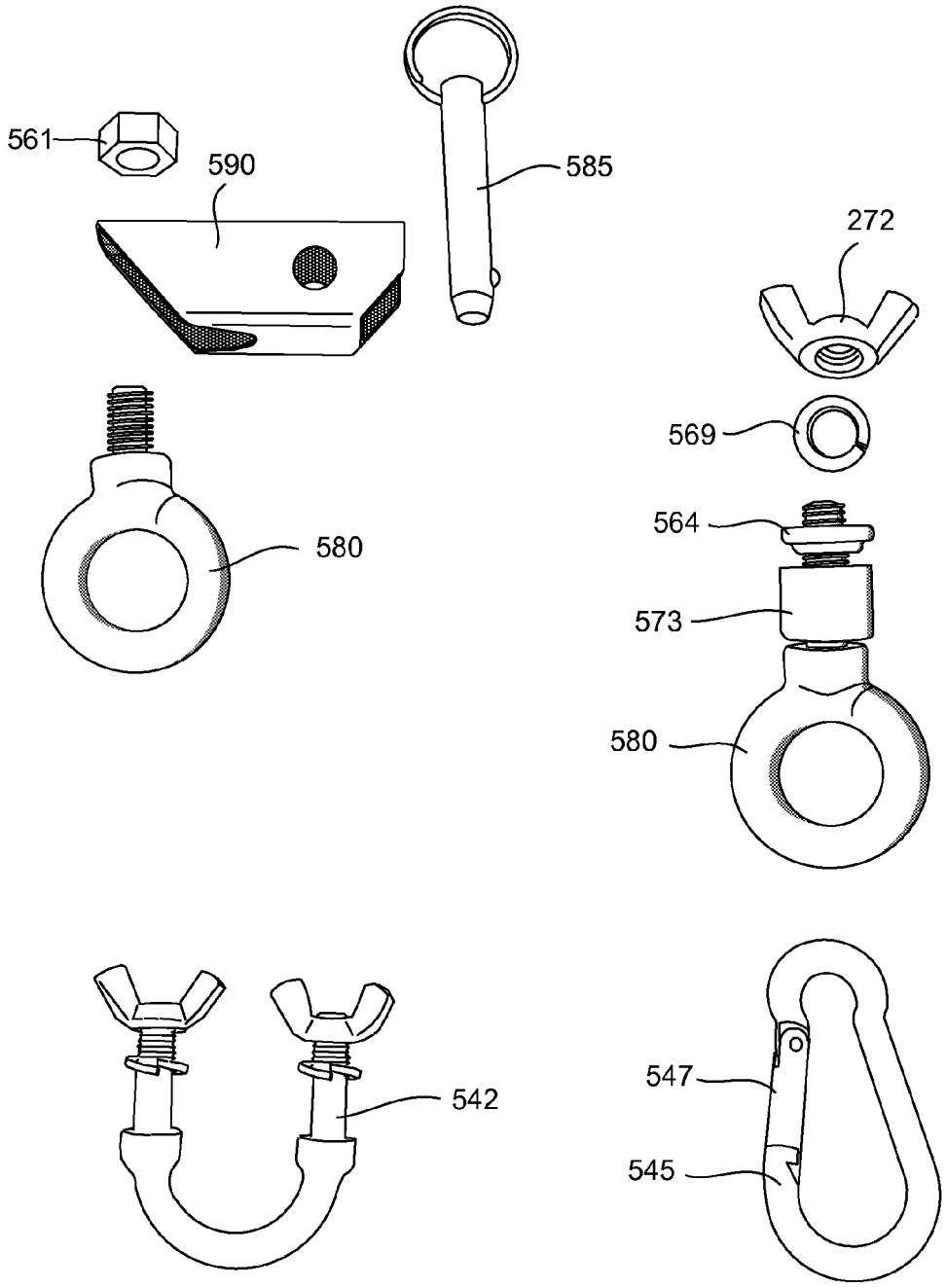
FIGS. 5B-5D are diagrams of illustrative REVERSAROLLER rear links, according to one example of principles described herein.

FIG. 5B shows a number of illustrative rear links (582, FIG. 5A) which could be used to guide the cable at the rear of a vehicle. In one configuration, a wing nut (272) and split ring lock washer (569) are used to secure an bolt eye (580) to the ATV (310, FIG. 5A). The wing nut (272) is used for easy attachment when rear winching is needed and easy removal when the task is completed. In order for the cable (40, FIG. 5A) to properly clear the under carriage of the ATV (310, FIG. 5A), various spacers (564, 573) could be used to position the bolt eye (580). Alternatively, the bolt eye (580) could be attached with a standard nut or locking nut.

The bolt eye (580) could also be attached using a receiver hitch (590) that fits into the receiver hitch receptacle located in the rear of an ATV (310, FIG. 5A) or other vehicle. The receiver hitch (590) is secured into the receptacle using a tow pin (585). The bolt eye (580) extends up through the receiver hitch (590), and is secured in place using a nut (561). Once the bolt eye (580) is in place, the cable (40, FIG. 5A) can either be threaded through the eye of the bolt eye (580), or a spring loaded snap link (545) can be attached to the bolt eye (580). Attaching a spring loaded snap link (545) has the advantage of not having to thread the cable (40, FIG. 5A) through a closed geometry. The cable (40, FIG. 5A) can be put in and out of the snap link (545) at any point along its length by opening the spring arm (547).

Figure 5D:
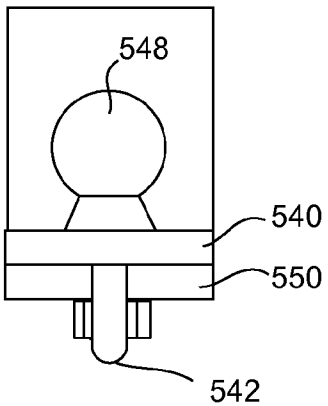
Figure 5C:
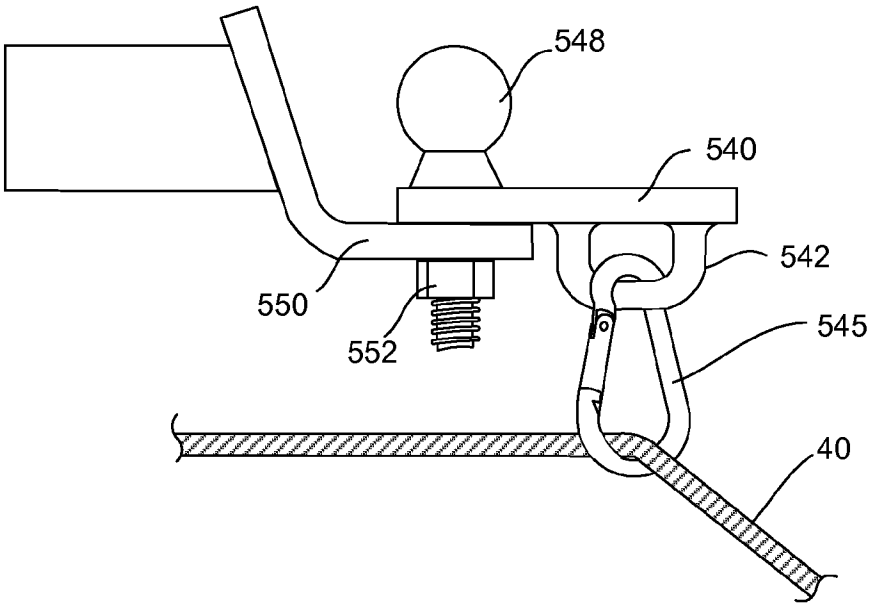

A variety of other devices could also be used as rear links, including, but not limited to shackles, carabineers, U-bolts (542) or other suitable devices. FIGS. 5C and 5D show a side and a front view, respectively, of an illustrative rear link configuration that accommodates a trailer ball (548). In this example, a trailer ball (548) is mounted to a hitch (550). A plate (540) is mounted between the trailer ball (548) and the nut (552) that secures the trailer ball (548) in place. A U bolt (542) is welded to one end of the plate (540). A snap link (545) can be attached to the U bolt (542) when the reverse winching is desired. The winch cable (40) can then be placed into the snap link (545). After the reverse winching is performed, the snap link (545) and cable (40) can be removed and stowed. FIG. 5D shows a front view of the rear link configuration with the snap link (545) and cable (40) removed.

Figure 6:
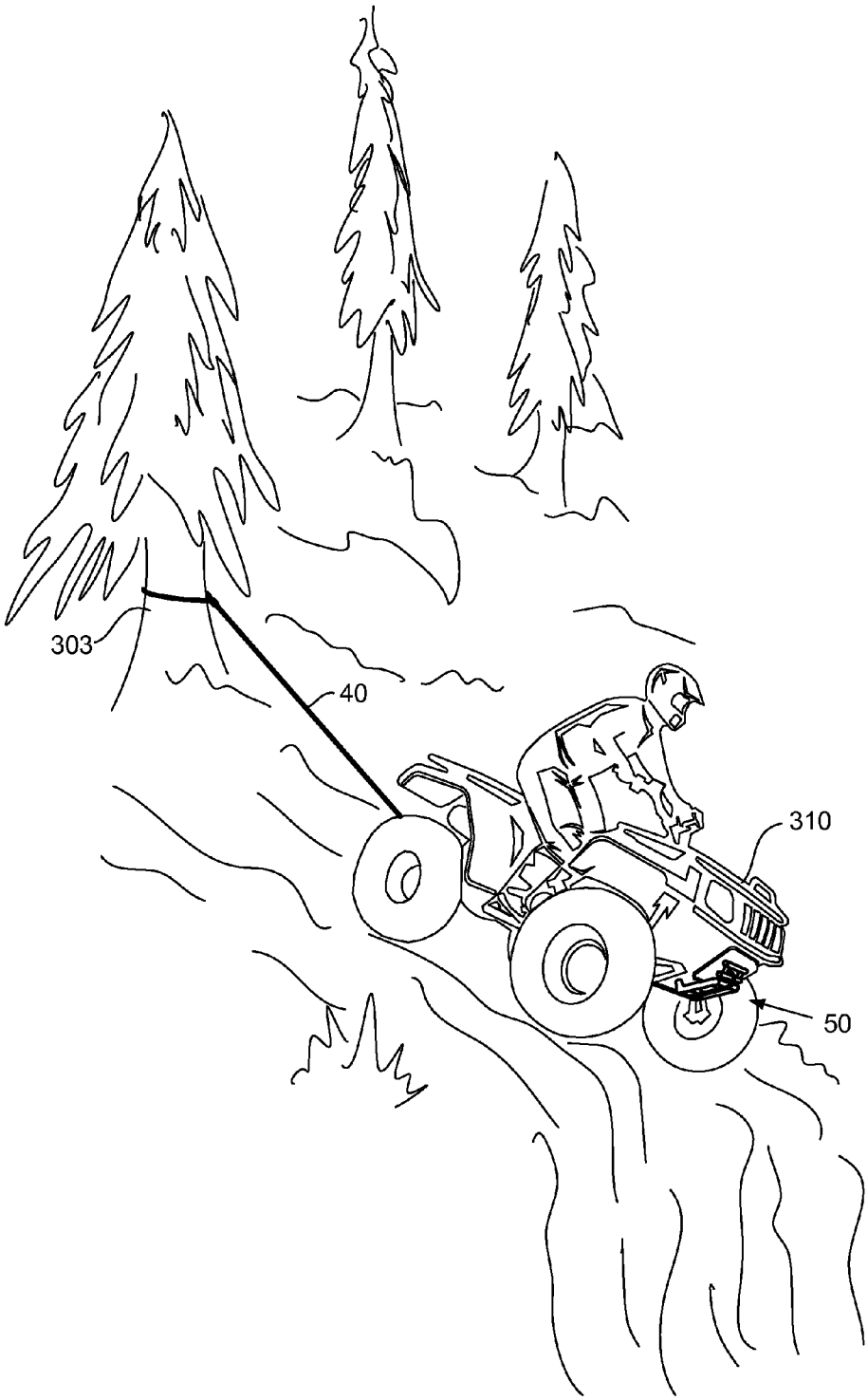
FIG. 6 is an illustrative example of the REVERSAROLLER winching apparatus being used for self rescue or forward decent, according to one example of principles described herein.

FIG. 6 is an illustrative example of the REVERSAROLLER winching apparatus (50) being used for self rescue or forward descent. As discussed above, the REVERSAROLLER winching apparatus (50) is mounted to the ATV and includes a roller fairlead, an extension arm, and a rear link. The REVERSAROLLER winching apparatus (50) allows a cable (40) from the front mounted winch to be attached to a rear anchor point. In this example, the rear anchor point (303) is a tree. The cable (40) is safely routed beneath the ATV (310) by the REVERSAROLLER winching apparatus (50).

If the rider desires to continue forward over the drop off, the configuration shown in FIG. 6 could be used for forward descent winching. For forward descent winching, the rider uses handlebar or remote controls to pay out cable from the front mounted winch. This lowers the ATV over the drop off in a controlled fashion. The rear link controls the relative motion of the cable and the rear of the ATV. This prevents the ATV from flipping over during the descent. Thus, the REVERSAROLLER winching apparatus allows for safe descent of an incline which is too steep to otherwise pass.

The rider may desire to retreat from the drop off, but is unable to turn around or back out of the situation due to poor traction, obstacles, or the steep incline. In this case, the REVERSAROLLER winching apparatus allows the rider to perform self rescue by reverse winching. The rider uses the controls to take up cable using the front mounted winch. This draws the vehicle toward the rear anchor point and out of danger.

Figure 7:
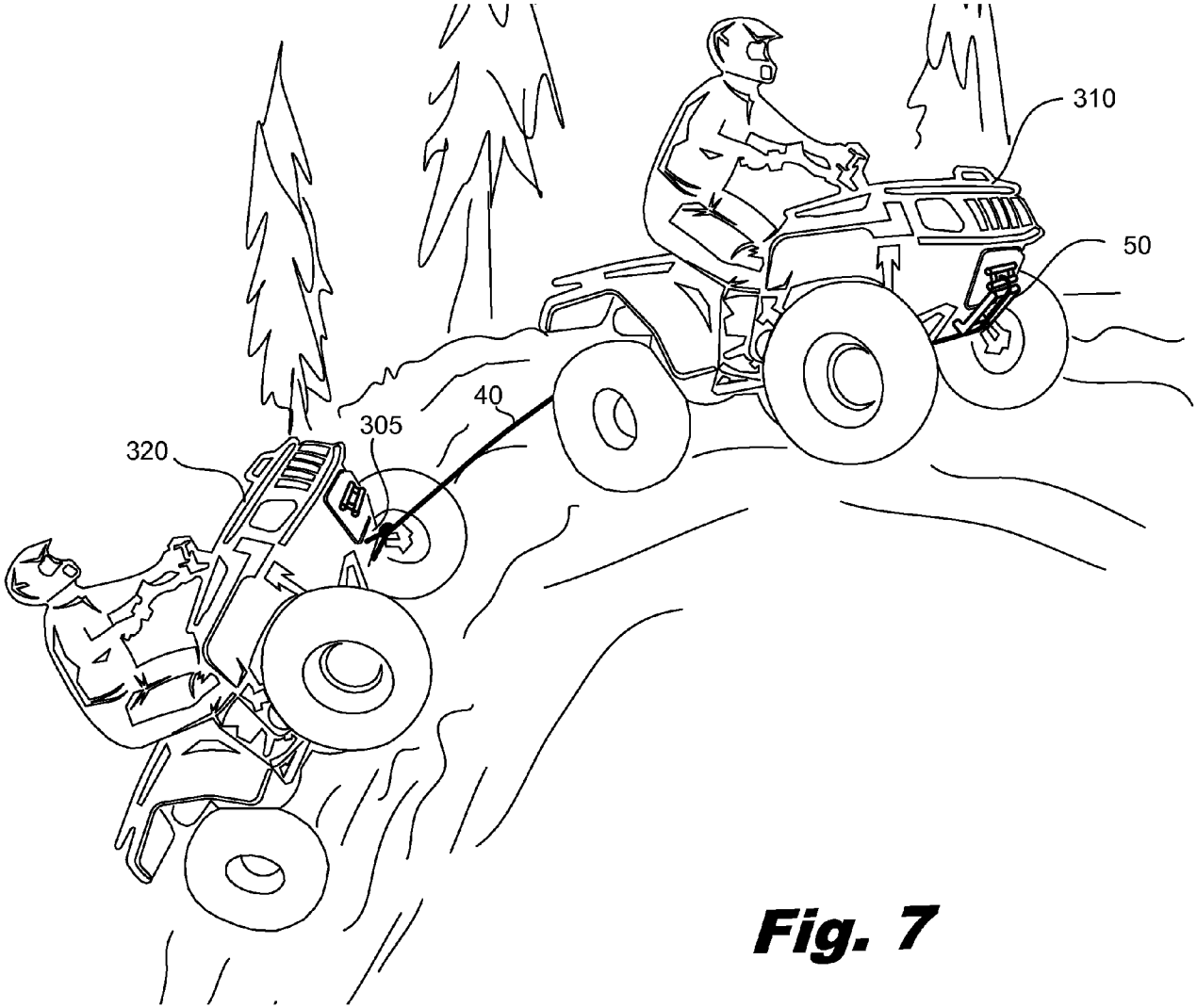
FIG. 7 is an illustrative example of the REVERSAROLLER winching apparatus being used to rescue another ATV or vehicle, according to one example of principles described herein.

Another illustrative example of the REVERSAROLLER winching apparatus (50) is shown in FIG. 7. This shows the REVERSAROLLER winching apparatus (50) being used to rescue a second ATV (320) or vehicle. In this case, the second ATV (320) serves as the rear anchor point (305). The cable (40) is routed under the first ATV (310) as discussed above and connected to the front of the second ATV (320) at an anchor point (305). As referred to in the specification and the appended claims, the term "rear anchor point" is used broadly and refers to anything attached to the end of the cable during use of the REVERSAROLLER. The rear anchor point may be mobile or stationary. For example, a moving rear anchor point could be an ATV which is being rescued, and a stationary rear anchor point could be a tree that the cable has been attached to as shown in FIG. 7.

Towing the second ATV (320) from the rear of the first ATV (310) makes best use of tire traction and ATV stability. The REVERSAROLLER winching apparatus (50) on the first ATV (310) provides optimal pulling power and control to provide safe assistance to the second vehicle (320).

In conclusion, the specification and figures describe illustrative examples of a REVERSAROLLER winching apparatus that includes a roller fairlead, extension arm with a fifth roller, and a rear link. The REVERSAROLLER winching apparatus is configured to safely route a cable from a front mounted winch under the vehicle to a rear anchor point. This allows for forward descent winching, rearward winching, and rescue of a trailing second vehicle using a front mounted winch.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A winching apparatus comprising:

a fairlead mounted to a vehicle, a cable from a winch passing through the fairlead, in which the winch is mounted to a front of the vehicle; and a rear link attached near a rear of the vehicle, the cable passing under the vehicle and through the rear link to an anchor point.

2. The apparatus of claim 1, a fifth roller mounted below the fairlead, the fifth roller being positioned and sized such that the cable does not contact any portion of the vehicle between the fairlead and the fifth roller when the cable passes from the winch under the vehicle, in which the fifth roller is shaped to bias the cable toward the center of the fifth roller.

3. The apparatus of claim 2, in which the fifth roller is mounted to a fifth roller bracket attached to the fairlead.

4. The apparatus of claim 2, in which fifth roller is mounted to a bracket which is integral to the fairlead.

5. The apparatus of claim 2, in which the fifth roller is detachably mounted to the fairlead by a quick release mechanism.

6. The apparatus of claim 2, further comprising an arm attached to the fairlead, the cable being supported by the arm such that the cable does not contact undercarriage of the vehicle as the cable passes under the vehicle.

7. The apparatus of claim 6, in which the arm is detachable from the fairlead using a quick release mechanism.

8. The apparatus of claim 6, in which the arm comprises a bottom roller.

9. The apparatus of claim 8, in which arm further comprises a standoff bracket which is configured to position the bottom roller such that the cable does not contact the vehicle as the cable passes under the vehicle.

10. The apparatus of claim 8, in which the arm further comprises a retention wire that passes over the bottom roller configured to retain cable.

11. The apparatus of claim 8, in which the bottom roller is shaped to bias the cable to the center of the bottom roller.

12. The apparatus of claim 7, in which the arm is detachably connected to the fairlead by a pin which passes through the fifth roller, the arm pivoting about the pin.

13. The apparatus of claim 12, in which the pin is a spring loaded toggle pin.

14. The apparatus of claim 1, in which the rear link is mounted to a towing attachment point on the rear of the vehicle.

15. A winching apparatus comprising:

a front-mounted winch mounted to a vehicle;

a roller fairlead mounted in front of the winch, the roller fairlead comprising a bracket and rollers mounted in the bracket;

a cable controllably retracted or extended by the winch, the cable passing through the roller fairlead;

a fifth roller mounted adjacent to the roller fairlead, the fifth roller being positioned and sized such that the cable does not contact the bracket when the cable passes from the winch under the vehicle; and a rear link connected to the rear of the vehicle, the cable passing through the rear link to an anchor point.

16. A method for winching comprising:

passing a cable from a front mounted winch over a fifth roller;

passing the cable through a rear link; and attaching the cable to an anchor point.

17. The method of claim 16, further comprising:

connecting a detachable arm to a fairlead with a removable pin passing through the fifth roller.

18. The method of claim 16, further comprising fastening a retention wire over the cable to retain the cable as it passes over a bottom roller of a detachable arm.

19. The method of claim 16, further comprising activating the winch to control cable motion for one of: forward descent winching, rearward winching, and rear rescue winching.

20. A winching apparatus comprising:

a winch mounted to a vehicle;

a cable connected to the winch;

a four roller fairlead mounted to the vehicle, the four roller fairlead comprising:

a bracket mounted to the vehicle; and four rollers rotatably connected the bracket to form a opening through which the cable passes, with a first roller above the opening, a second roller below the opening, a third roller on a left side of the opening, and a fourth roller on a right side of the opening; and a fifth roller mounted adjacent and parallel to one of the first, second, third, or fourth rollers, in which the fifth roller is mounted using a quick release mechanism passing through the center of the fifth roller and forming an axis about which the fifth roller rotates.

21. A winching apparatus comprising:

a fairlead mounted to a vehicle, a cable from a winch passing through the fairlead;

a fifth roller mounted below the fairlead, the fifth roller being positioned and sized such that the cable does not contact any portion of the vehicle between the fairlead and the fifth roller when the cable passes from the winch under the vehicle;

an arm detachably connected to the fairlead by a quick release mechanism, the cable being supported by the arm such that the cable does not contact undercarriage of the vehicle as the cable passes under the vehicle.

22. A method for winching comprising:

passing a cable from a front mounted winch over a fifth roller;

passing the cable through a rear link;

attaching the cable to an anchor point; and fastening a retention wire over the cable to retain the cable as it passes over a bottom roller of a detachable arm.

* * * * *